United States Patent [19]

Pinto

[11] Patent Number: 4,823,440

[45] **Date of Patent: * Apr. 25, 1989**

[54] WEB WEIGHT CONTROL SYSTEM

[75] Inventor: Akiva Pinto, Gastonia, N.C.

[73] Assignee: John D. Hollingsworth On Wheels, Inc., Greenville, S.C.

[ * ] Notice: The portion of the term of this patent subsequent to Sep. 1, 2004 has been disclaimed.

[21] Appl. No.: 90,736

[22] Filed: Aug. 28, 1987

Related U.S. Application Data

[63] Continuation-in-part of Ser. No. 886,711, Jul. 18, 1986, Pat. No. 4,689,857.

[51] Int. Cl.[4] ..... D01H 5/38

[52] U.S. Cl. ..... 19/105; 19/106 R

[58] Field of Search ..... 19/105, 106 R

[56] References Cited

U.S. PATENT DOCUMENTS

| | | | |
|---|---|---|---|
| 4,133,455 | 1/1979 | Moser | 19/300 |
| 4,506,413 | 3/1985 | Leifeld | 19/300 X |
| 4,574,433 | 3/1986 | Brunnschweiler | 19/300 X |
| 4,689,857 | 9/1987 | Pinto | 19/105 |

*Primary Examiner*—Louis K. Rimrodt

*Attorney, Agent, or Firm*—Cort Flint

[57] ABSTRACT

A web weight control system and method are disclosed wherein the actual weight of fibers supplied to a carding machine (36) are measured in a weight pan (20) or while moving on a conveyor (22) by a sensor (92). the supply roll (14) is controlled by computer (A) to supply a preset weight of fibers. The weighed fibers are supplied on an apron feed (22) to a pneumatic delivery system (28). The delivery of weighed fibers by apron feeder (22) may be adjusted by adjusting the speed of an apron feed roll (50*a*). This maintains a prescribed quantity or level of fiber in a fiber storage chute feed (32). Pressure sensed by a pressure gauge (52) is used to indicate quantity of fiber in chute feed (32) and pressure signal (53) is fed to computer (A) for control of delivery roll (50*a*). Card feed roll (62) which feeds fibers in the form of a batt (35) from chute feed (32) to the carding machine is controlled by computer (A) in synchronization with the speed of the carding machine as sensed by doffer roll (68). A preset web weight signal (48) is compared to an actual weight signal (46) representing the actual weight of fibers supplied. Any difference between is compensated for by adjustment of the operation of card feed roll (62), and adjustment of fiber supply roll (14).

19 Claims, 3 Drawing Sheets

PRESET
A
W
F

WEB WEIGHT CONTROL SYSTEM

This is a continuation-in-part of copending application Ser. No. 886,711, filed on July 18, 1986, which is now U.S. Pat. No. 4,689,857, issued on Sept. 1, 1987.

BACKGROUND OF THE INVENTION

The invention relates to controlling the production weight of a carding machine in direct response to the actual weight of fiber material going into a feeding system of the carding machine. Typically, a carding machine or card is fed a fiber batt from a chute feed. The chute feed has a pair of delivery rolls between which the fiber batt is delivered to a feed roll of the carding machine. The chute feed roll speed may be related to the production rate of the carding machine. The doffer roll speed (production rate) and desired weight of the web or sliver produced on the card determine the weight of the fiber batt and speed of the card feed roll. The invention relates to the control of the weight of a web which is produced from such a carding machine.

Heretofore, it has been common to sense variations in the density or weight of the fiber batt supplied from the chute feed to the carding machine and control the weight accordingly to produce a desired web weight. For example, gamma rays, displacement of one of the chute delivery rolls, a weight scale, etc. have all been used to indicate density or weight of the fiber batt. The batt weight and the speed of the card feed roll are then used to control the desired weight of the web produced by the card. U.S. Pat. No. 4,506,413 discloses one such system.

It has also been known to regulate a fiber supply machine in response to quantities of fiber stored in a fiber chute feed fed by the supply machine as in U.S. Pat. No. 4,535,511.

A weighing device is shown in U.S. Pat. No. 4,387,486 which measures the weight of a batt delivered from a chute feed to a carding machine. This signal is used to change the weight of the batt output from the chute feed so that the output weight of the web produced by the card is changed correspondingly. The speed of the card feed roll may be controlled by the weight signal to produce a corresponding desired weight output of the web from the card.

However, the problem occurs in the prior system and methods that the weight is measured while a fiber batt or web is flowing through the process which is a dynamic process. Thus, due to frictional losses and other losses, a real sensing of the weight of fiber material in the process does not occur.

It has also been known to check the weight of the web coming from the output of the card and control the speed of the card feed roll correspondingly to produce a desired web or sliver weight such as shown in U.S. Pat. No. 4,393,547. However, this involves a problem in that there is a real time lag between the sensing of the web weight and the changing of the card feed roll so that you do not get an accurate or instantaneous correction to the weight of the web by sensing on one end and correcting on the other end of the carding process.

The above methods involve sensing a function of the weight of a web or batt while it is in a dynamic flowing condition. While this may produce a representation of the fiber batt weight being fed to the carding machine or the weight of the web being produced, the prior sensing devices and methods have not sensed that actual or real weight.

It has also been known to feed a carding machine directly from an apron feeder on which fibers are deposited from a weigh pan. The output of the weigh pan may be controlled by sensing the weight of the web produced by the carding machine. However, the problems occur that there is little control over the cross sectional weight of the batt. The dumping of fibers on an apron fed directly to a card results in the card being fed in steps or lumps resulting in non-uniform weight in the lengthwise direction of the web also.

Accordingly, an object of the present invention is to control the weight of a web produced by a carding machine by sensing the real weight of fibers fed to the carding machine in a static condition.

Another object of the invention is to control the weight of a web produced by a carding machine by using the actual consumption weight of fibers delivered to the system by a weigh pan device, and a present consumption weight.

Still another object of the invention is to provide a system and method which controls the weight of a web produced by a card in a manner that is more accurate than has been heretofore achieved by using the real weight of fibers delivered to the system as measured by a weigh pan device.

Yet another object of the present invention is to produce an accurate web weight on a carding machine by sensing actual input fiber weight and controlling the fiber supply roll, fiber delivery roll, and card feed roll in synchronization with the card machine and one another.

SUMMARY OF THE INVENTION

The above objectives are accomplished according to the present invention by an electronic control system and method for controlling the weight of a web produced on a carding machine of the type wherein fiber is fed from a fiber supply roll to a fiber weighing device which deposits a weighed amount of fiber into a fiber delivery system which delivers fiber to a fiber storage chute. The fiber storage chute feeds fiber in the form of a fiber batt to a card feed roll which feeds the fiber batt to the carding machine. The actual weight of fibers supplied to the fiber delivery system is measured by a weigh pan and an actual fiber weight signal is generated corresponding to the actual weight of fibers. The quantity of fibers stored in the fiber storage chute is sensed and a fiber quantity signal is generated corresponding to the quantity of fiber in the storage chute. A preset web weight signal is established which corresponds to a desired weight for the web being produced by said carding machine. The operation of the card feed roll is controlled by an electronic controller in response to a comparison of the actual fiber weight signal and the preset web weight signal. The operation of the card feed roll is adjusted to maintain the weight of the web at the preset web weight during production. The fiber delivery roll is controlled in response to the fiber quantity signal to maintain a prescribed fiber quantity in the fiber storage means as the operation of the card feed roll is controlled and varied. The operation of the fiber supply roll is controlled in response to the actual fiber weight signal to adjust the weight of fiber supplied to the fiber delivery system and maintain a prescribed fiber supply weight. The control of the fiber supply roll, fiber delivery system, and card feed roll are synchronized with the speed of the carding machine in predetermined ratios.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
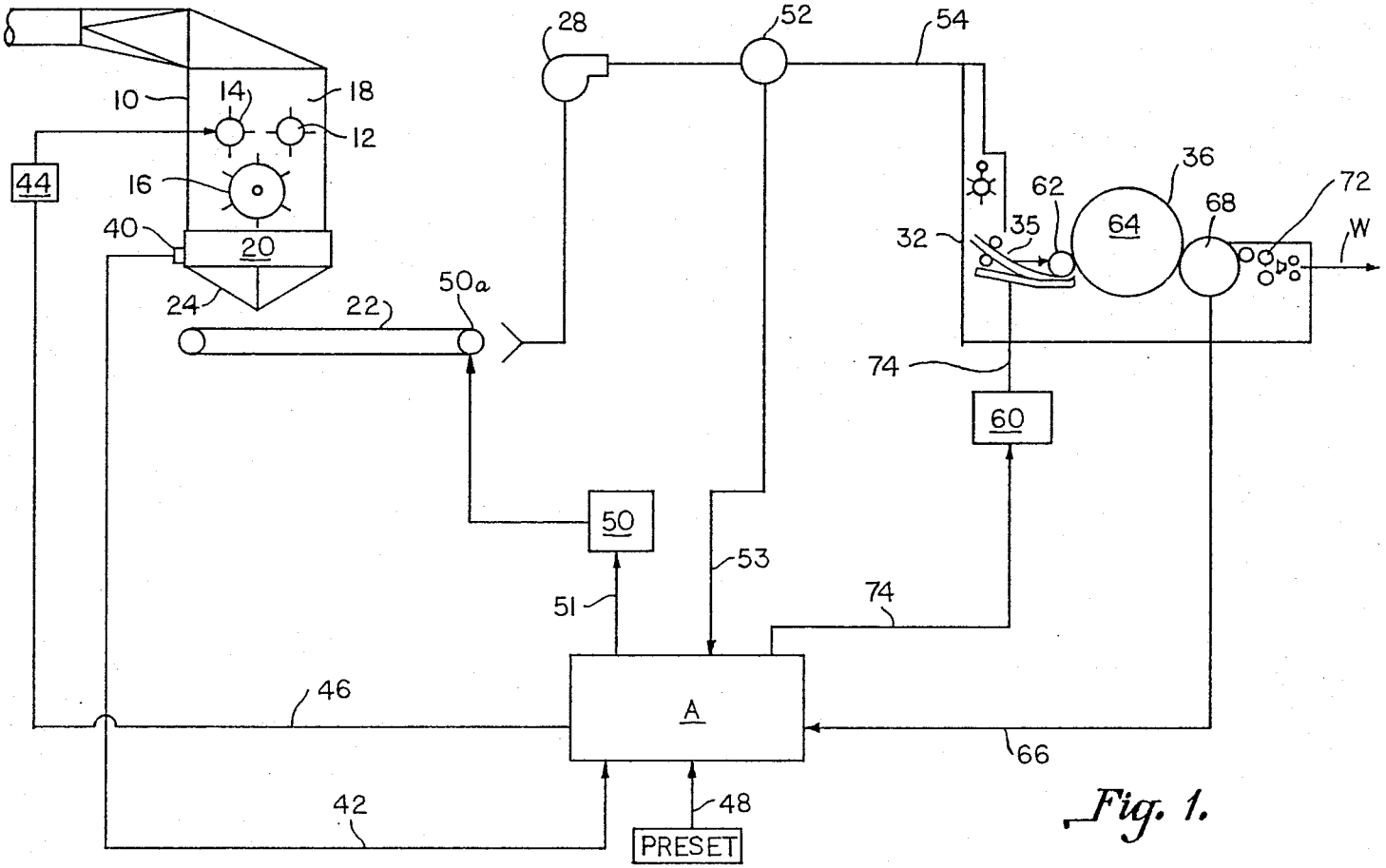
FIG. 1 is a schematic view illustrating a web weight control system and method according to the invention.
Figure 2:
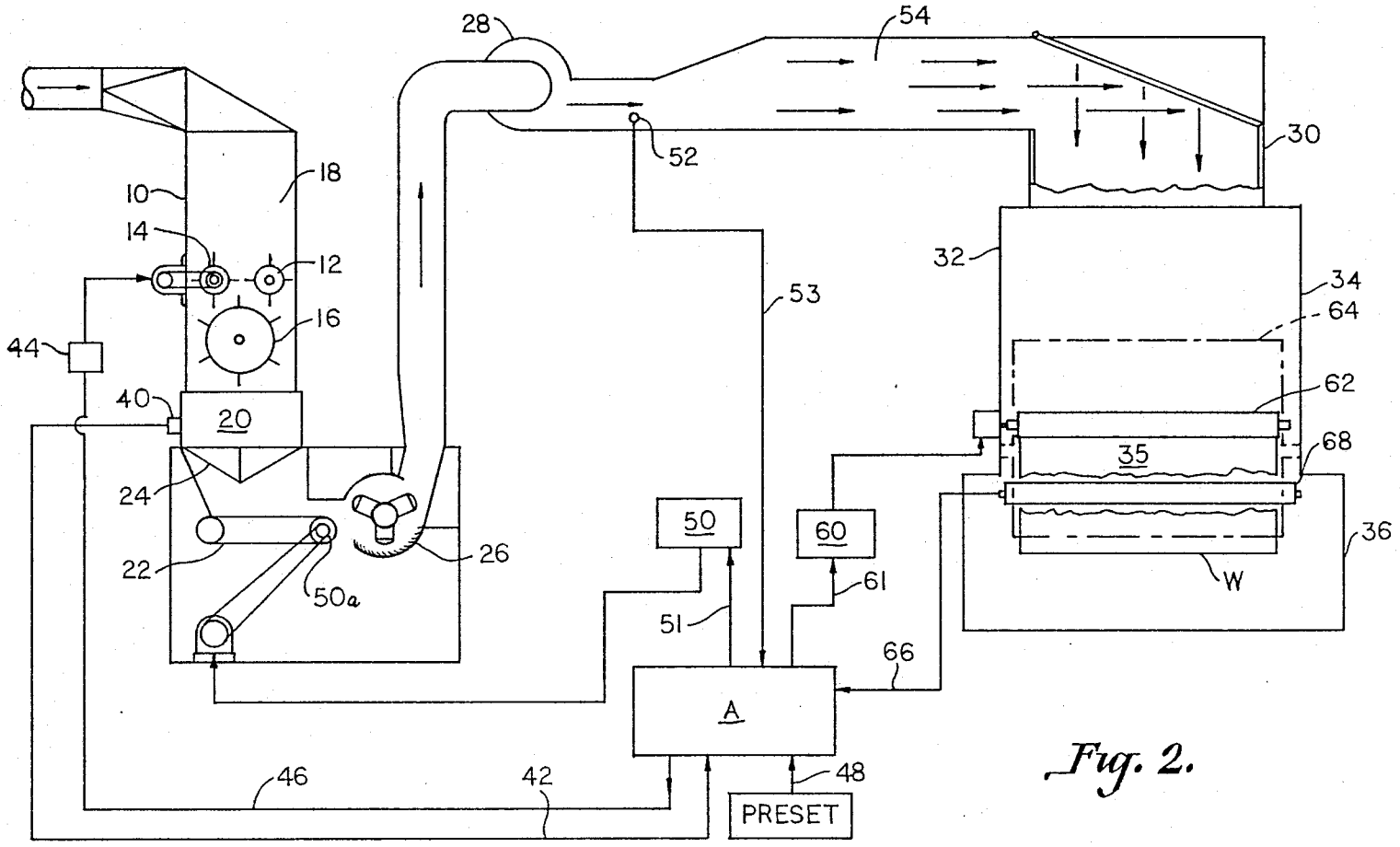
FIG. 2 is a schematic view illlustrating in more detail a web weight control system and method according to the invention.

Referring now to FIG. 1, there is illustrated a fiber supply means in the form of a fiber opening and supply machine 10 which may comprise a pair of supply rolls 12 and 14 which supply fiber to an opening roll 16 which are all located in a supply chute 18. There is a weigh pan 20 at the end of the supply chute which weighs the fibers and delivers them onto a traveling feed apron 22. Fiber supply roll 14 is controlled to supply a preset amount of fiber to weigh pan 20. Weigh pan 20 includes a pair of hinged doors 24 which open and close to supply a desired weight of fibers. Fibers are delivered from the feed apron 22 to an opening roll 26 from where the fibers are placed into a pneumatic delivery system having a transport blower 28. The fibers are delivered by airflow into a reserve section 30 of a fiber chute feed 32. A lower formation section 34 receives the fibers and compacts them into a desired weight for delivery in the form of a compacted fiber batt 35 to a carding machine 36.

Weighing means for producing an actual weight signal of fiber includes a load cell 40 which measures the weight of fibers in the weigh pan 20. Load cell 40 produces a signal 42 which represents the actual weight of fibers and is delivered to a control means in the form of a computer A.

The load cell 40 senses the weight of the weigh pan 20 and any fiber collected therein and transmits signals to computer A to indicate weight. The computer A is programmed to receive the weight signals 42 and determine the weight sensed by the load cell 40 during each cycle. This weight is temporarily retained in the memory of the computer as the full weight of the weigh pan 20 and fiber. This weight includes the total weight of the weigh pan 20 and any fiber collected therein.

After the doors 24 of weigh pan 20 have been opened and the fiber released, a signal from load cell 40 is transmitted to computer A representing the weight of the empty weigh pan. The empty weigh pan's weight is accurately determined because computer A is programmed to make this determination after recognizing that the fibers have been released on opening of doors 24. Computer A is programmed to determine mine the exact, actual weight of fiber released from the weigh pan 20 during each cycle by obtaining the difference between the empty weight and the full weight.

After this actual weight has been determined, it may be compared with a preset fiber weight calculated by computer A. The preset fiber weight will be that weight of fiber necessary for supply to the fiber feeding system in order to produce a carding web W having a desired weight. If the actual weight of fiber dumped onto feed apron 22 and the preset weight are the same, no adjustment is made to the system. However, if the actual weight is greater or less than the preset fiber weight, computer A will generate an adjustment signal represented by a weight control signal 46 which controls a motor controller 44 to control the speed of the supply roll 14 accordingly. By controlling the on/off operation of supply roll 14, the weight of fiber delivered to weigh pan may be adjusted so as to deliver the preset weight of fiber. U.S. Pat. No. 4,448,272 discloses a weigh pan device which may be referred to in more detail and is incorporated herein by reference.

A preset web weight is input ito computer A at 48 which is the weight per square meter that is desired for the web produced by the card. The preset fiber supply weight may be determined from the preset web weight.

Fiber delivery means for delivering a supply quantity of fiber to chute feed 32 and carding machine 36 includes apron feeder 22 and pneumatic delivery system 28. There is a motor controller 50 which controls the speed of apron delivery roll **50*a* according to computer signal 51 in a prescribed manner. The controller 50 is controlled by computer A to synchronize the speed of the apron delivery roll 50*a* with the speed of the carding machine. Therefore, if the card is accelerating, the apron feed roll will be driven at a faster speed to maintain the required input for the card while accelerating. Should the card be decelerating, then the speed of the apron feed roll will be reduced correspondingly. The same is true for fiber supply roll 14 which is also synchronized. During normal operation, the speed of the apron feed roll 50 will be controlled by pressure sensed by a pressure guage 52 located in the pneumatic delivery duct 54 which feeds the chute feeder 32. A signal 53 of the pressure of fiber-laden air in duct 54 indicates a prescribed quantity of fibers to be maintained in storage means 32. While any suitable controller may be utilized, one suitable control system is disclosed in applicant's co-pending application entitled Flock Feed Control System. Basically, the control system senses pressure by guage 52 as an indication of the quantity of fiber delivered to chute feed 32 and controls the speed of apron feed roll 50*a* to maintain a desired quantity of fiber in the chute feed 32**.

There is a means for feeding fiber batt 35 from chute feed 32 to the carding machine 36 in the form of a card feed roll 60. There is a card feed roll motor control 62 which controls the speed of a card feed roll 62. The speed of the carding machine, or the production rate, may be measured by sensing the speed of a doffer roll 68 which is fed to the computer as signal 66. This speed may be checked by sensing the speed of web delivery roll 72 if desired. Computer A receives doffer speed signal 66 and computes a card feed roll signal 61 in accordance with a predetermined ratio of doffer speed and synchronized with a supply roll 14 and delivery roll 50.

In operation, and by way of example, a three-meter wide card will be used with a preset web weight of 25 grams per square meter and a card production speed (doffer roll speed) of 100 meters per minute. This will require a consumption rate of 7,500 grams per minute of fiber at full production speed. Computer A, is programmed for a three-meter wide card and determines a preset consumption by knowing the preset web weight and the speed of the doffer roll 68 thus computing a preset consumption rate of 7,500 grams per minute. The computer is programmed to control motor controller 44 of supply roll 14 to supply weigh pan 20 with a prescribed weight of fibers. For example, if the weigh pan dumps three times per minute, each dump will be 2,500 grams exactly to meet the actual consumption of 7,500 grams per minute of the card to produce the preset web weight. Motor controller 44 will turn supply roll 14 on first at a high rate and then at a low rate until 2,500 grams is delivered to the weigh pan. This occurs three times per minute at production speed.

Having computed the preset consumption of the card needed to produce a preset web weight to be 7,500 grams per minute at production speed, the actual or real consumption of the card for instance may be 7,425 grams per minute as computed from load cell signal 42 previously described. Since the real or actual consumption is below the level of preset consumption by ten percent (10%), it is necessary to produce a signal 61 to feed roll controller 60 to speed up the card feed roll 62 in order to increase the consumption to the desired level of 7,500 grams per minute. When this is done, there may be an under supply of fibers in feed chute 32 of the fiber delivery system. Accordingly, this will cause a drop in pressure and a corresponding pressure signal 53 will be delivered to computer A and controller 50 will be controlled threrby. The speed of apron feed roll 50*a* will accordingly be increased to ensure that an adequate supply of fibers is present in the system to meet the new consumption speed of feed roll 62 all of which is programmed in computer A.

If, for example, the actual consumption of fibers as measured by load cell 40 is greater than 7,500 grams per minute, then computer A will calculate the reduced speed for feed roll 62 so that the web weight will not be above the preset web weight. In this event, if a pressure increase is detected by sensor 52 in chute feed 32 indicating an oversupply and pressurization of fiber, apron delivery roll 50*a* will be controlled accordingly in a decreased manner to reduce the supply of fiber to chute feed 32. When the actual consumption of fibers from weigh pan 20 is equal to the preset consumption of fibers (i.e. 7,500 grams per minute) then, of course, no adjustment will be made to the system.

Computer A may be any well known microprocessor unit or programmable controller. It will be understood that details of the microprocessor or controller is itself no part of the present invention, except to the extent that it provides one commercially available means suitable for use in carrying out the steps of the present invention in an automatic manner. The programming techniques for adapting a microprocessor or programmable controller to each of the control steps is well known in the microprocessor and programmable controller arts.

Thus, it can be seen that an advantageous control and method of the weight of a web produced on a carding machine can be had in accordance with the invention in dependence on the actual weight of fiber supplied to the feeding system of the carding machine. The actual weight of fiber put in may be compared to the preset weight of fiber required for the web. Any difference in the actual and preset weights is adjusted by controlling the fiber supply roll, fiber delivery roll, and a card feed roll in synchronization and predetermined ratio with the card doffer roll (output) speed.

The electronic drive by which the speed of the doffer of the card and the card feed roll are driven together at a predetermined speed ratio is adjusted by signal 42 generated in response to the actual weight of fiber supplied to the card. Likewise, fiber delivery roll 50*a* is adjusted as needed to maintain fiber quantity levels stored for feeding the card. In this manner, a change in the actual weight of supplied fiber will be adjusted by synchronous change of the supply, delivery, and card feed rolls so that the entire feeding and carding system remains driven electronically in predetermined ratios with each other to produce a preset web weight in a highly accurate manner.

Once the card is at production speed, should the actual weight be different than the preset weight, fiber feed supply roll 14 is adjusted to maintain actual weight, and card feed roll 62 is adjusted to maintain the web weight. Correspondingly, as card feed roll 62 is adjusted up and depletion of fiber in chute feed 32 varied more or less than normal, the pressure will be sensed resulting in adjustment up of fiber delivery roll 58 accordingly. Similarly, fiber feed means 10, fiber delivery means 50*a*, and card feed means 62 are driven in synchronization with carding machine operation via sensing the speed of doffer roll 68 during start-up of the carding machine where the carding machine is accelerating and fiber need be fed in a quick manner, and upon card deceleration wherein feeding and delivery of fiber need be decreased.

Figures 3, 3A:
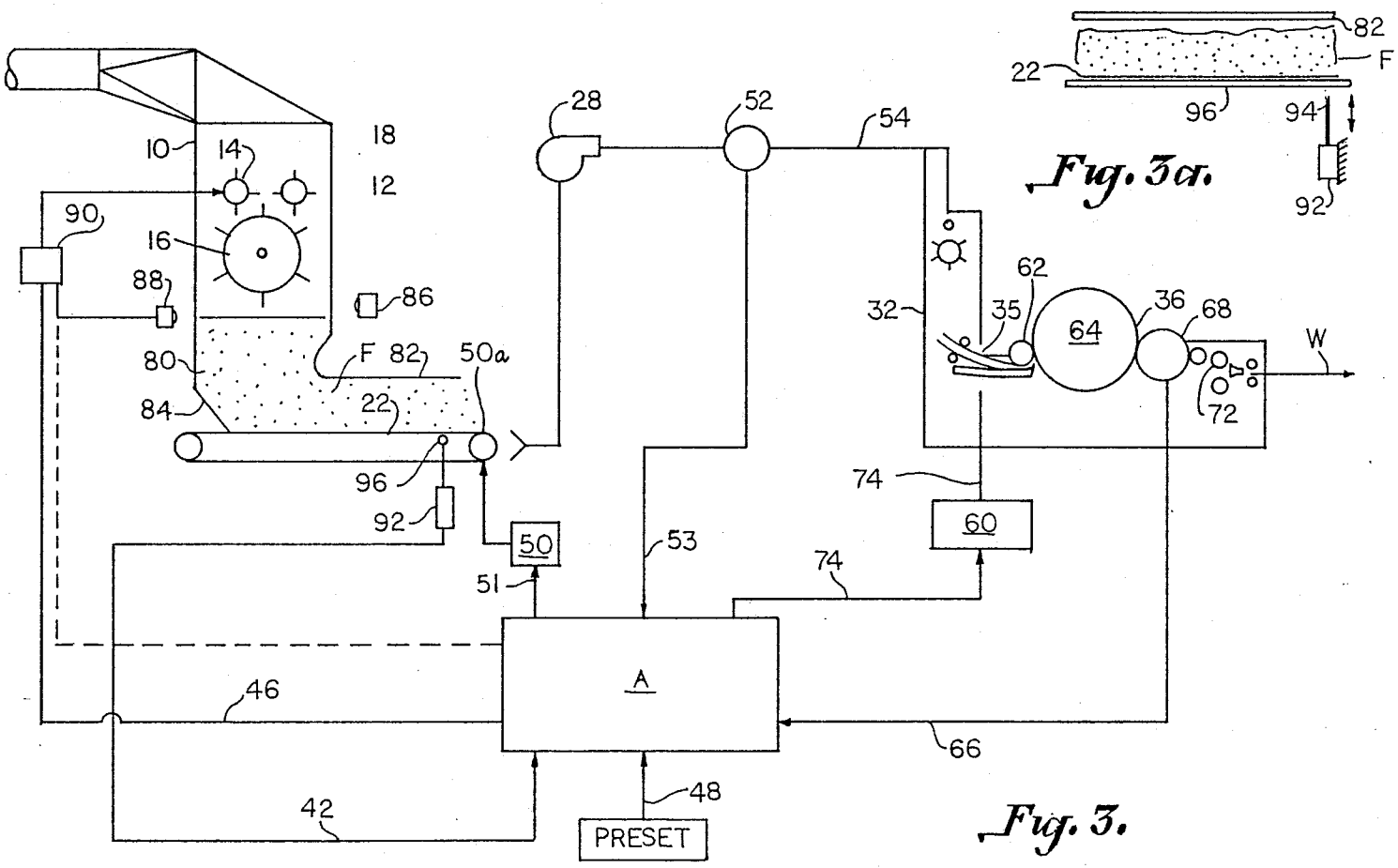
FIG. 3 and *3a* are schematic views illustrating an alternate embodiment of a web weight control system and method according to the invention.

An alternate weight control system is illustrated in FIG. 3 wherein the fibers are weighed while being transported on a conveyor means in the form of apron conveyor 22. This avoids having to weigh the fibers in the weigh pan first and then drop the fibers onto the conveyor. In one step, the fibers may be weighed and conveyed as shown in FIG. 3. The loose fibers are weighed while undergoing transportation in a relative dynamic state in a more expedient process. Fiber opening machine 10*a* includes a drop chute 80 which includes a horizontal wall 82 and a rearally inclined wall 84 which terminates adjacent apron 22. Supply control means for maintaining a quantity of fibers in drop chute 80 is provided by a photocell detector which includes a light source 86 and a pick up 88 which delivers a signal to control circuit 90 to control the rate of operation of supply rolls 12 and 14. Weighing means for sensing the actual weight of fibers "F" supplied to the pneumatic delivery system and for generating a signal corresponding to the actuated fibers is provided by a transducer 92. Transducer 92 may be a conventional load cell for sensing the load on conveyor means 22. Preferrably, transducer 92 is a linear variable differential transformer (LVDT) which is capable of accurately measuring displacements smaller than fractions of one-thousandths of an inch. Movement of a plunger 94 is measured by transducer 92. Plunger 94 is connected to a horizontal rod 96 which bears against the underneath portion of the upper run of conveyor 22, as can best be seen in FIG. 3*a*. Rod 96 may be a rod or a roller mounted for vertical displacements, and for this purpose may be mounted on suitable guides for vertical movement (not shown). The load and weight of fiber on conveyor 22 pushes the rod 96 more or less to give an indication of the weight of fibers on the apron being delivered to the fiber delivery system. The actual weight signal 42 from transducer 92 will be delivered to computer A and processed in the same manner as the actual weight signal 42 from the weigh pan in the embodiment of FIG. 1. If the actual weight of fibers is less than the preset weight of fibers then conveyor 22 will be speeded up. If less fibers are needed the conveyors will be slowed down. If the conveyor is accelerated to provide more fibers and the level of fibers in drop chute 80 decreases, supply control means 88 will turn on or speed up fiber supply roll 12 or 14 as needed. The photocell signal may be delivered to computer A which controls motor controller 90, and directly to motor controller 90. In the event sufficient fiber level and quantity cannot be maintained in drop chute 80, computer A can make necessary adjustments, i.e. slow production. The remaining method and systems operate the same as in the previous embodiment. In accordance with the embodiment of FIGS. 3 and 3*a*, it can be seen that an advantageous construction can be had with the invention wherein weighing of the fibers may be accomplished in a one step process instead of a weigh pan. Weighing and conveying may be done at the same time with the results and expedience of the invention being inherent in either method.

While a preferred embodiment of the invention has been described using specific terms, such description is for illustrative purposes only, and it is to be understood that changes and variations may be made without departing from the spirit or scope of the following claims.

What is claimed is:

1. A method for controlling the weight of a web produced on a carding machine of the type wherein fiber is fed from a fiber supply means to a fiber weighing means which supplies a weighed amount of fiber into a fiber delivery means which delivers fiber to a fiber storage means, said fiber storage means feeding fiber in the form of a fiber batt to a card feed roll which feeds the fiber batt to the carding machine, said method comprising:

sensing the actual weight of fibers supplied to said fiber delivery means during conveyance to said fiber delivery means and generating an actual fiber weight signal corresponding to the actual weight of fibers; the improvement comprising weighing said fibers while being transported by a conveyor means;

sensing the quantity of fibers stored in said fiber storage means and generating a fiber quantity signal corresponding to the quantity of fiber in said storage means;

establishing a preset web weight signal corresponding to a desired weight for the web being produced by said carding machine;

controlling the operation of said card feed roll in response to a comparison of said actual fiber weight signal and said preset web weight signal and adjusting the operation of said card feed roll to maintain the weight of said web at said preset web weight during production;

controlling the fiber delivery means in response to said fiber quantity signal to maintain a prescribed fiber quantity in said fiber storage means as the operation of said card feed roll is controlled and varied; and controlling the operation of said fiber supply means in response to said actual fiber weight signal to adjust the weight of fiber supplied to said fiber delivery means and maintain a prescribed fiber supply weight.

2. The method of claim 1 comprising synchronizing the operation of said fiber supply means, fiber delivery means, and card feed roll with the speed of the carding machine.

3. The method of claim 1 including the further steps of:

determining a preset fiber consumption rate of said carding machine required to produce a web having said preset web weight;

determining an actual fiber consumption rate of said carding machine based on said actual fiber weight of fiber supplied said fiber delivery means; and controlling the operation of said card feed roll in response to the difference between said preset fiber consumption rate and said actual consumption rate in order to maintain the weight of said web at said preset web weight value.

4. The method of claim 3 comprising sensing the production rate of said carding machine and using said production rate to determine said actual and preset fiber consumption rates based on said actual fiber weight and said preset web weight, respectively.

5. A method of producing a web on a carding machine in which the weight of the web is accurately controlled comprising the steps of:

selecting a preset web weight corresponding to a weight which is desired for the web and generating a preset web weight signal representing said preset web weight;

weighing loose fibers supplied to a feeding system of the carding machine and generating an actual fiber weight signal representative of the actual weight of fibers supplied;

generating actual fiber weight signals as fibers are weighed for supply to said carding machine continuously during the carding process; and controlling the operation of a card feed roll of the carding machine as a function of said preset web weight signal and said actual fiber weight signals to maintain the production of a web having said preset web weight; and the improvement comprising weighting said fibers while being transported by a conveyor means.

6. The method of claim 5 further comprising:

adjusting the weight of said loose fibers supplied to said fiber feeding system in response to said actual fiber weight signals in a manner that a prescribed weight of this fiber is delivered to said fiber feeding system.

7. The method of claim 5 further comprising weighing said fibers while moving in a generally dynamic state.

8. The method of claim 7 including supplying said loose fibers for weighing from an opening machine which opens said fibers; and controlling the quantity of fibers in said opening machine.

9. The method of claim 5 further comprising weighing said fibers upstream of a fiber storage means which stores the fibers and forms them into a fiber batt for feeding to said card feed roll.

10. The method of claim 9 including:

sensing the quantity of fibers delivered to said fiber storage means; and controlling a fiber delivery means which delivers fiber to said fiber storage means to maintain a prescribed quantity of fibers in said storage means as the operation of said card feed roll is controlled and varied.

11. The method of claim 5 further comprising the steps of:

weighing said fibers while being transported by conveyor means by a weighing means upstream of a fiber storage means which stores the fibers and forms them into a fiber batt for feeding to said card feed rolls; and adjusting the weight of said fibers supplied to said storage means by adjusting the travel rate of said conveyor means in response to said actual fiber weight signals to maintain a preset fiber weight supplied to said weighing device.

12. The method of claim 11 including:

sensing the quantity of fibers delivered to said fiber storage means;

adjusting the rate of a fiber delivery means which receives said fibers from said conveyor means and delivers said fibers to said storage means to maintain a prescribed quantity of fibers in said storage means as the operation of said card feed roll is varied; and adjusting the rates of said card feed roll, conveyor means, and fiber deivery means in synchronization with the production rate of said carding machine to maintain the weight of fibers, the delivery of fibers to said fiber storage means, and feed of fibers to said carding machine in predetermined ratios during the carding process.

13. Apparatus for controlling the weight of a web produced by a carding machine of the type having a fiber feeding system which includes a fiber supply means which supplies and weighs the fibers, and fiber delivery means for delivering said weighed fibers to a fiber storage means which stores said fibers and forms said fibers into a fiber batt for feeding to a card feed roll of the carding machine, said apparatus comprising:

first sensor means operatively connected to said fiber supply means for weighing fibers being supplied to said fiber delivering means by said fiber supply means and generating a fiber weight signal corresponding to the actual weight of fibers being supplied;

a preset web weight signal representing a desired weight for said web produced by said carding machine;

control means connected to receive said actual fiber weight signal and said preset web weight signal;

said control means connected to said card feed roll to control the rate that said fiber batt is fed to said carding machine by said card feed roll as a function of the comparison of the actual fiber weight signal and said preset web weight signal; and the improvement comprising said fiber supply means including a conveyor means for transporting fibers to said fiber delivery means, and said first sensor means weighing said fibers while being transported by said conveyor means.

14. The apparatus of claim 13 including:

said control means connecting to said fiber supply means for controlling the operation of said conveyor means in response to said fiber weight signal to adjust the weight of fiber supplied in a manner to maintain preset weight of fibers supplied to said fiber delivery means.

15. The apparatus of claim 13 wherein said fiber supply means includes an opening machine which opens the fibers and supplies said open fibers to said conveyor means which weighs said fibers in a dynamic condition, and including supply control means for maintaining a desired quantity of fibers in said opening machine for supply to said conveyor means.

16. The apparatus of claim 13 wherein said apparatus comprises a card operation sensor for sensing the production rate of said carding machine and generating a production rate signal; and wherein said control means determines a preset fiber consumption rate based on said preset web weight and said production rate and determines an actual fiber consumption signal based on the actual fiber weight and said production rate which are compared for controlling said card feed roll.

17. The apparatus of claim 13 including:

second sensor means for sensing the quantity of fiber delivered to said fiber storage means and generating a fiber quantity signal; and said control means connected to said second sensor means for receiving said fiber quantity signal for controlling said fiber delivery means to maintain a prescribed quantity of fibers in said storage means in synchronization with the control of said card feed roll.

18. The apparatus of claim 17 wherein said second sensor means comprises a pressure sensor for sensing the pressure of fiber-laden air flowing in a delivery duct to the fiber storage means which includes a fiber chute feed.

19. The apparatus of claim 18 wherein said conveyor means, fiber delivery means, and card feed roll, are driven in a synchronized manner with said card production rate in a manner that said actual fiber weight, stored fiber quantity, and fiber batt weight are controlled in accordance with predetermined ratios.

* * * * *